United States Patent [19]

Stanton

[11] 4,449,018

[45] May 15, 1984

[54] HEARING AID

[76] Inventor: Austin N. Stanton, 3017 Stonehenge La., Carrollton, Tex. 75006

[21] Appl. No.: 386,020

[22] Filed: Jun. 7, 1982

[51] Int. Cl.[3] ..... H04R 5/00

[52] U.S. Cl. ..... 179/107 FD; 179/107 R

[58] Field of Search ..... 179/107 FD, 156 R, 182 R, 179/1 GA, 1 G, 107 R

[56] References Cited

U.S. PATENT DOCUMENTS

| | | | |
|---|---|---|---|
| 3,800,082 | 3/1974 | Fish . | |
| 3,993,407 | 11/1976 | Moricca et al. . | |
| 4,037,328 | 7/1977 | Kuehn et al. . | |
| 4,113,984 | 9/1978 | Gilbert et al. . | |
| 4,188,504 | 2/1980 | Kasuga et al. . | |
| 4,322,744 | 3/1982 | Stanton | 179/156 R |
| 4,338,489 | 7/1982 | Görike | 179/156 R |

FOREIGN PATENT DOCUMENTS 2741004 3/1979 Fed. Rep. of Germany .

OTHER PUBLICATIONS

Fish, Raymond M., "An Audio Display for the Blind", IEEE Transactions on Biomedical Engineering, vol. BME-23, No. 2, Mar. 1976, pp. 144-153.

Damaske, P., "Head-Related Two-Channel Stereophony with Loudspeaker Reproduction", The Journal of the Acoustical Society of America, vol. 50, No. 4 (Part 2), 1971, pp. 1109-1115.

Roffler and Butler, "Factors that Influence the Localization of Sound in the Vertical Plane", The Journal of the Accoustical Society of America, vol. 43, No. 6, 1968, pp. 1255-1259.

Nakabayashi, Katsumi, "A Method of Analyzing the Quadraphonic Sound Field", Journal of the Audio Engineering Society, Apr. '75, vol. 23, No. 3, pp. 187-193.

*Primary Examiner*—G. Z. Rubinson
*Assistant Examiner*—L. Schroeder
*Attorney, Agent, or Firm*—Richards, Harris & Medlock

[57] ABSTRACT

Apparatus is described for restoring the original comprehension of sounds reaching a human ear, including direction, elevation and frequency. An enclosure surrounds the pinna of the ear to substantially exclude exterior sounds. First and second speakers are placed in a chamber, within the enclosure, anterior to the pinna, such that each transducer radiates to the entire pinna. The speakers are mounted on the inner surface of the anterior wall of the enclosure along a vertical line which is generally parallel to the vertical axis of the pinna. First and second microphones are mounted on the anterior surface of the enclosure also along a vertical line and are connected respectively to the first and second speakers through amplifying means. The speakers reproduce the received sounds and through the dissimilarities in the sound provide the hearer with the sense of the angular elevation of the source. In a further embodiment an external sound source is connected to provide dissimilar sounds to the first and second speakers, thus also providing a sense of elevation to the user. The amplifier includes electronic filter elements supplementing those parts of the tonal and volume sensitivity required to restore normal hearing. When the apparatus is provided for each ear, total sound discrimination is restored to the user.

9 Claims, 2 Drawing Figures

HEARING AID

TECHNICAL FIELD

The present invention pertains to apparatus for providing sounds to the human ear and in particular to such apparatus for providing multiple dissimilar sounds to each ear.

BACKGROUND ART

Hearing loss, from whatever cause, is seldom uniform over the wide range of frequencies recognized by the human ear. Suppression of the amplitude of the mid-range sounds to those of the less favored ranges restores the relative value of different frequencies. Amplification restores the sound level over the entire range. Many well known electronic means are available for each of these functions.

Perception of orientation of received sounds is possible because the sounds arrive at the two ears at slightly different times. Phase comparison by the brain is interpreted as the direction of the sound source.

Even smaller differences occur with sounds arriving at the upper and lower areas of the pinna of the human ear. These sounds are reflected into the auditory canal where they arrive at the cochlea completely intermixed. They are separated and separately processed by the brain. Phase comparisons produce specific knowledge of the angular elevation of the source of the sound.

Given the broad binaural hearing of youth, the brain is further able to sort sounds and concentrate its attention on specific sound qualities, enabling one to converse quietly even when assaulted by many other and louder noises.

As hearing is progressively impaired, the discriminatory abilities are lost. The goal of hearing supplementation is to restore all of these abilities. To do so, inputs equivalent to vertical separation are also required.

Multiple-element speaker systems, such as conventional stereo home entertainment equipment, provide a plurality of sound sources which are received at the ear simultaneously. The multiple sources provide an enhanced effect for the sound, usually music. However, the universal approach to multiple-element sound systems for both stereo (two-channel) and quad (four-channel) has been to place the speakers in the horizontal plane. The pick-up elements, microphones, are likewise placed in a corresponding horizontal plane such that the recording and reproduction of the sounds provide a horizontal dimension.

Conventional aids for hearing impaired persons do not provide the sound orientation of normal hearing. These aids produce confusing sounds which substantially diminish the useability of the devices.

Additional background information regarding multiple source sound systems is given in U.S. Pat. No. 4,322,744 to Austin N. Stanton.

There has been little or no development of sound systems which provide sound separation in planes other than the horizontal. The human ear can be responsive to sounds in the vertical dimension which have phase and amplitude variations just as it is responsive to such sounds in the horizontal dimension. Therefore, there exists a need for apparatus for providing dissimilar sounds to the human ear with the differing components being oriented in the vertical plane.

SUMMARY OF THE INVENTION

A selected embodiment of the present invention comprises apparatus for audible assistance to those with impaired hearing which comprises a vertically arrayed group of audio speakers positioned anterior to the pinna of the human ear, each of the speakers independently radiating sounds to the ear.

A further embodiment is disclosed for providing dissimilar sounds to the human ear. This structure includes an enclosure which surrounds the pinna of the ear to substantially exclude exterior sounds from the ear. The enclosure has an interior space which is anterior to the pinna of the ear. First and second audio transducers are mounted to the enclosure with the radiating elements thereof exposed to the anterior space within the enclosure. The transducers are spaced along a line which is generally parallel to the vertical axis of the pinna. The transducers are connected to receive inputs which provide dissimilar sounds to the ear. In a further aspect of the present invention there are included first and second microphones which are mounted on the exterior of the enclosure and spaced along a line which is also essentially parallel to the vertical axis of the pinna. The first and second microphones are connected respectively to the first and second transducers for providing the inputs to the transducers.

BRIEF DESCRIPTION OF THE DRAWINGS

For a more complete understanding of the present invention and the advantages thereof, reference is now made to the following Description taken in conjunction with the accompanying Drawings in which.

DETAILED DESCRIPTION

Figure 1:
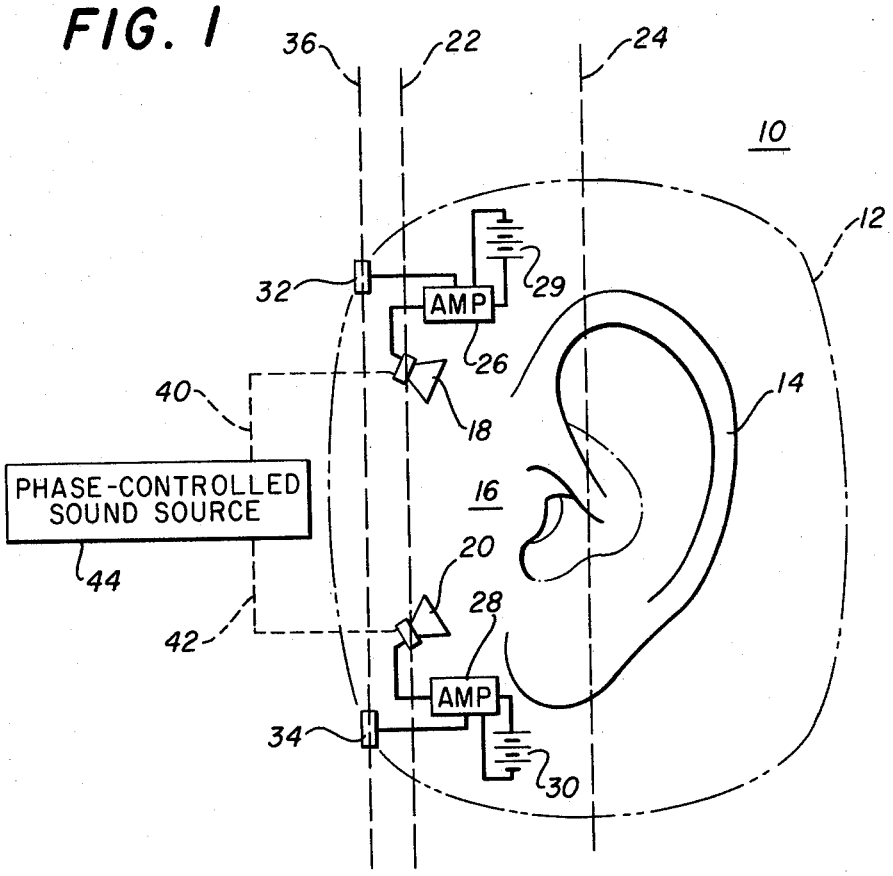
FIG. 1 is an elevation view of an enclosure which surrounds the pinna of the ear together with apparatus mounted to the enclosure.

Referring to FIG. 1 there is shown a structure 10 which includes a generally oval enclosure 12. The enclosure 12 surrounds the pinna 14 of the ear. The enclosure 12 fits against the head of the user and encloses the pinna 14 such that exterior sounds are essentially excluded from the ear.

The enclosure 12 includes an anterior space 16. Space 16 is forward of the pinna 14.

An audio transducer 18 is mounted to the interior of the enclosure 12 such that the radiating element of the transducer is exposed to the space 16. Likewise an audio transducer 20 is mounted to the interior of enclosure 12 with the radiating element exposed to the space 16. The transducers 18 and 20 are mounted to the enclosure 12 along a line 22 which is essentially parallel to a line 24 that defines the vertical axis of the pinna 14. Each of the transducers 18 and 20 can radiate to the entire pinna 14. The transducers 18 and 20 are preferably wide band audio speakers.

The transducers 18 and 20 are driven respectively by amplifiers 26 and 28 which provide dissimilar sounds to the respective transducers. Amplifiers 26 and 28 are powered respectively by batteries 29 and 30. The amplifiers 26 and 28 are preferably adjusted to complement the hearing loss of the user. This is accomplished by utilizing selective frequency filters which are incorporated in the amplifiers 26 and 28.

Microphones 32 and 34 are mounted on the exterior of enclosure 12 along a line 36 which is likewise generally parallel to the vertical axis line 24. The microphones 32 and 34 are connected respectively to the amplifiers 26 and 28 to provide inputs to the transducers 18 and 20. Microphones 32 and 34 are mounted in a forward looking direction to emphasize sounds received from the user's field of view.

In an optional arrangement the inputs to the transducers are provided through lines 40 and 42 which are in turn connected to a phase-controlled sound source 44.

The device shown in FIG. 1 comprises what is termed as "Otobooster", that is, an aid for boosting the comprehension of sound by the human ear.

The operation of the structure 10 is now described in reference to FIG. 1. In a first arrangement the microphones 32 and 34 are connected through the amplifiers 26 and 28 to the transducers 18 and 20. The sounds received by the microphones 32 and 34 have amplitude and phase differences which are a function of the vertical orientation of the microphones. These dissimilar sounds received by the microphones are reproduced by the transducers 18 and 20 so that the ear perceives the differences. Such an arrangement can be extremely helpful for the hearing impaired since it provides not only amplified sounds but spatial orientation as well.

Filters in the amplifiers 26 and 28 can be set to have a frequency response curve that complements the user's audio acuity thereby giving the user a wide frequency comprehension.

In a further arrangement of the present invention the microphones 32 and 34 are not utilized and input signals are provided directly from a phase-control sound source 44 through lines 40 and 42 directly to the transducers 18 and 20. The external source 44 can provide dual channel sound, such as prerecorded tapes or records, which have been recorded to have vertical signals components. Further the source 44 could receive a single input signal and provide appropriate phase shift to simulate vertical sound orientation.

Figure 2:
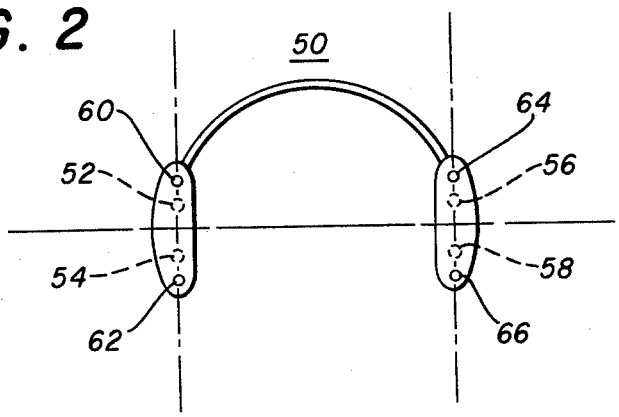
FIG. 2 is an elevation view of a complete headset which includes two of the enclosures illustrated in FIG. 1.

A complete headphone 50 is illustrated in FIG. 2. Headphone 50 includes two of the structure 10 devices as described in FIG. 1 wherein the individual is provided with four audio transducers 52, 54, 56 and 58 and with four corresponding microphones 60, 62, 64 and 66. The presence of the transducers on each side of the head reproduces the differences in phase and amplitude in the horizontal plane. Thus the hearing impaired user is provided with both horizontal and vertical orientation for the sounds in his environment. Such orientation is not provided by conventional hearing aids in which a single channel is provided for each ear.

Although several embodiments of the invention have been illustrated in the accompanying Drawings and described in the foregoing Detailed Description, it will be understood that the invention is not limited to the embodiments disclosed, but is capable of numerous rearrangements, modifications and substitutions without departing fron the scope of the invention.

I claim:

1. Apparatus for audible assistance to persons with impaired hearing, comprising:

a vertically arrayed group of audio speakers positioned anterior to the pinna of a human ear, each said speaker independently radiating sounds to the ear, a vertically arrayed set of microphones positioned anterior to said speakers, said microphones corresponding respectively to said speakers, and an amplifier for each of said speakers, each said amplifier interconnecting the corresponding ones of said microphones and said speakers.

2. The apparatus of claim 1 including an electronic filter for each of said amplifiers for correcting hearing deficiencies of the ear.

3. The apparatus of claim 2 including an enclosure providing acoustic isolation, component support and a space enclosing the pinna and the speakers.

4. The apparatus of claim 3 including input terminals for supplying audio signals to each of said amplifiers.

5. The apparatus of claim 3 including two of said enclosures and means for supporting one of said enclosures about each ear.

6. Apparatus for providing sounds to the human ear, comprising:

an enclosure surrounding the pinna of the ear for substantially excluding exterior sounds from the ear, said enclosure providing a space anterior to the pinna, and first and second audio transducers mounted to said enclosure with the radiating elements thereof exposed to said anterior space, said transducers spaced along a line generally parallel to the vertical axis of the pinna and said transducers connected to receive inputs to provide dissimilar sounds to the ear.

7. The apparatus recited in claim 6 including first and second audio sensors mounted on the exterior of said enclosure, said microphones spaced along a line essentially parallel to said vertical axis of the pinna and said first and second sensors connected respectively to said first and second transducers for providing said inputs to said transducers.

8. Apparatus for providing sounds to the human ears, comprising:

an enclosure for each ear, each enclosure surrounding the pinna of the ear for substantially excluding exterior sounds from the ear, each enclosure providing a space anterior to the pinna, first and second audio transducers mounted to each of said enclosures with the radiating elements of said transducers exposed to the respective anterior spaces, the transducer for each enclosure spaced along a line generally parallel to the vertical axis of the pinna, and first and second microphones for each said enclosure, said microphones mounted to said enclosures on the exterior thereof along a line generally parallel to said vertical axis of the pinna and connected respectively to the first and second transducers in the corresponding enclosure wherein each pair of first and second transducers provides dissimilar sounds to the corresponding ear for vertical plane sound orientation and the two pairs of said transducers spaced apart for opposing ears provide horizontal plane sound or orientation.

9. The apparatus recited in claim 8 wherein said microphones are mounted in a forward looking direction.

* * * * *